US008447060B2

(12) United States Patent
Huang

(10) Patent No.: US 8,447,060 B2
(45) Date of Patent: May 21, 2013

(54) EARPHONE

(75) Inventor: Cheng-Houng Huang, Kowloon (HK)

(73) Assignee: Comaxtech International Limited, Kowloon (HK)

( * ) Notice: Subject to any disclaimer, the term of this patent is extended or adjusted under 35 U.S.C. 154(b) by 166 days.

(21) Appl. No.: 13/051,690

(22) Filed: Mar. 18, 2011

(65) Prior Publication Data

US 2011/0293130 A1 Dec. 1, 2011

(30) Foreign Application Priority Data

May 27, 2010 (TW) ..... 99210019 U

(51) Int. Cl.
*H04R 25/00* (2006.01)

(52) U.S. Cl.
USPC ..... 381/380; 381/374

(58) Field of Classification Search
USPC ..... 381/370, 380, 322, 328, 329; 181/129, 181/130, 135; 379/430; 455/575.1, 575.2
See application file for complete search history.

(56) References Cited

U.S. PATENT DOCUMENTS

2008/0013774 A1* 1/2008 Hosaka et al. ..... 381/380

* cited by examiner

*Primary Examiner* — Tuan D Nguyen

(57) ABSTRACT

An earphone comprises a trumpet unit, a hollow shield, and a guide sound tube: the shield is hollow to receive the trumpet, has a sound chamber and an opening, and the opening inclines an acute angle from the trumpet unit; the guide sound tube is disposed at the opening with an end communicating with the sound chamber and another end extending to the opening. The earphone is capable of presenting the high and low pitches completely and providing a better sound quality by way of the acute angle between the opening and the trumpet unit.

7 Claims, 6 Drawing Sheets

EARPHONE

BACKGROUND OF THE INVENTION

1. Field of the Invention

The present invention relates to an earphone, and, more particularly, to an earphone which is adapted to be worn by the users with different auricles and enhances comfort and sound quality.

2. Description of Related Art

The electronic products are developed along with technology incessant progress toward a tendency pursuing lightness and smallness, and it is very popular that the minimized electronic products or personal digital products such as the MP3, mobile phones, personal digital assistants (PDA) or laptop computers are available everywhere and become indispensable in our daily lives. Especially, the mobile phones in associated with a radio and an MP3 has been presented in the market already.

In order not to interfere others during listening sound information via the electronic products, the earphone has become one of the essential parts of the preceding electronic products. Besides, the earphone is capable of providing better transmission of sound for the user being able to listen to contents of the sound clearly instead of the sound transmitted via the air being less clear, especially the user being in motion such as taking exercise or intensely acting or being in a noisy environment.

Nevertheless, ears and canals of different persons are somewhat different in structure and size such that the user with small ears may feel tight or uncomfortable during the earphone being worn. Furthermore, a guide sound tube and a trumpet at the rear end of the guide sound tube, which are installed in the earphone, have weights to be subjected by the ears in addition to the outer side of the guide sound tube being provided with an ear cushion for supporting the weights; it is because the conventional trumpet is big and long and incapable of being inserted into the ear; under the circumferences, the rear end of the guide sound tube becomes droopy and the ear cushion deviates from a central position of the trumpet after the earphone is plugged to the ear. In this way, when the sound transmits to the ear from the trumpet via the guide sound tube, tone quality of the sound may frequency-shift and it often happens that the tone of the low pitch is normally presented but the tone of the high pitch is unable to be presented well, and as a result, the tone quality is degraded and poor.

SUMMARY OF THE INVENTION

The main objective of the present invention is to provide an earphone to improve the preceding disadvantages of the conventional earphone.

To achieve the objective, the earphone according the present invention comprises a trumpet unit, a shield, and a guide sound tube; the shield, which is hollow to receive the trumpet unit, has a sound chamber and an opening, and the opening inclines an acute angle from the trumpet unit; the guide sound tube is disposed at the opening with an end communicating with the sound chamber and another end extending to the opening. The earphone is capable of presenting the high and low pitches completely and providing a better sound quality by way of the acute angle between the opening and the trumpet unit.

Further benefits and advantages of the present invention will become apparent after a careful reading of the detailed description with appropriate reference to the accompanying drawings.

DETAILED DESCRIPTION OF THE INVENTION

Figure 1:
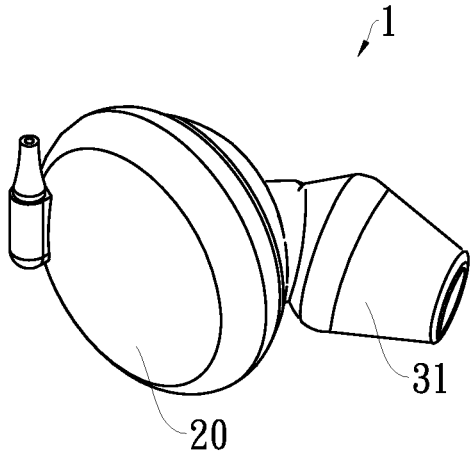
FIG. 1 is a perspective view of an earphone according to the present invention.
Figure 2A:
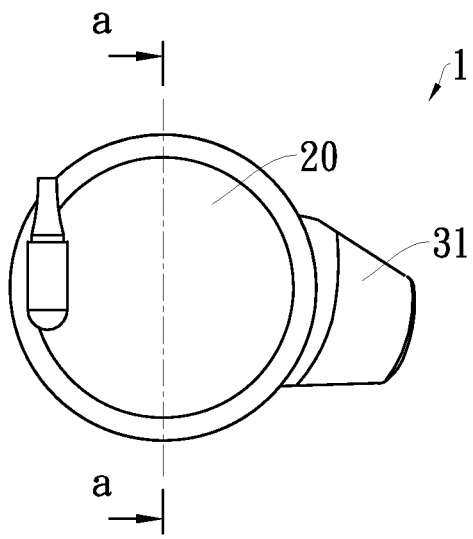
FIG. 2A is a front side view of the earphone shown in FIG. 1.
Figure 2B:
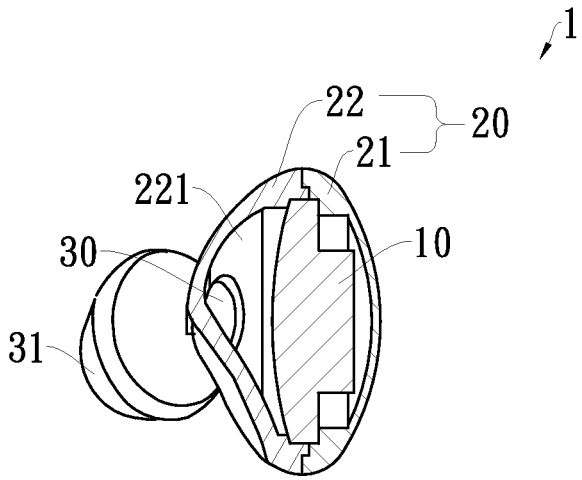
FIG. 2B is a sectional view along line a-a shown in FIG. 2A.
Figure 3A:
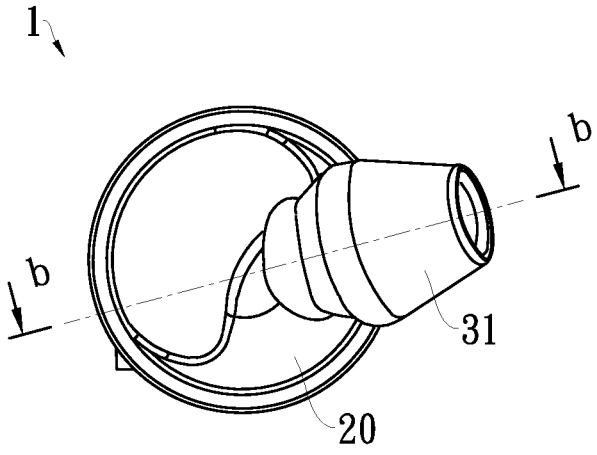
FIG. 3A is a rear side view of the earphone shown in FIG. 1.
Figure 3B:
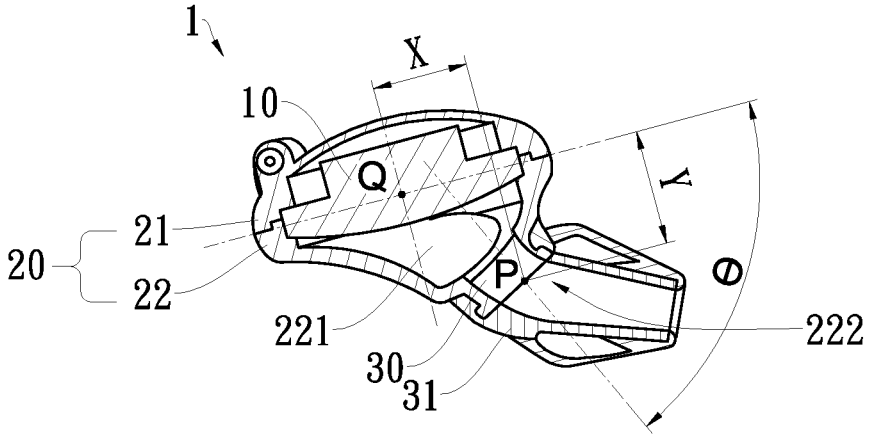
FIG. 3B is sectional view along line b-b shown in FIG. 3A.

Referring to FIGS. 1, 2A-2B, and 3A-3C, a preferred embodiment of an earphone in accordance with the present invention is designated a reference number 1 and comprises a trumpet unit 10, a shield 20, and a sound guide tube 30, wherein the trumpet unit 10 is utilized to change electronic signals to sound wave signals before transmitting outward; the shield 20 is hollow shape and consists of an upper shied portion 21 and a lower shield portion 22; the upper shield portion 21 is circular, and the lower shield portion 22 is inverted-triangle-shaped with a sound chamber 221 and an opening 222; the upper shield portion 21 and the lower shield portion 22 sandwich the trumpet unit 10 for the trumpet unit 10 being received between the upper and lower shield portions 21, 22. The trumpet unit 10 communicates with the sound chamber 221 for the sound emitted from the sound chamber 221 capable of generating an effect of resonance. An axis passes between the upper and lower shield portions 21, 22 and passes through the central position Q of the trumpet unit 10 as shown in FIG. 3B. It can be seen in FIG. 3B that a horizontal distance X along the axis is measured from the central position Q of the trumpet unit 10 to a center P of the opening 222, and a vertical distance Y perpendicular to the axis is measured from the central position Q of the trumpet unit 10 to the central center P of the opening 222. In practice, the horizontal distance X is 5 mm±1 mm and the vertical distance Y is 8 mm±1 mm. In addition, an acute angle θ between the axis and a line passing through the center P of the opening 222 is in a range of 60°~70° . It is noted that the line passes through the center P and intersects the axis near the central position Q; the intersection is away from the central position Q if the acute angle θ is greater, and the intersection is closer to the central position Q if the acute angle θ is less.

Figure 4:
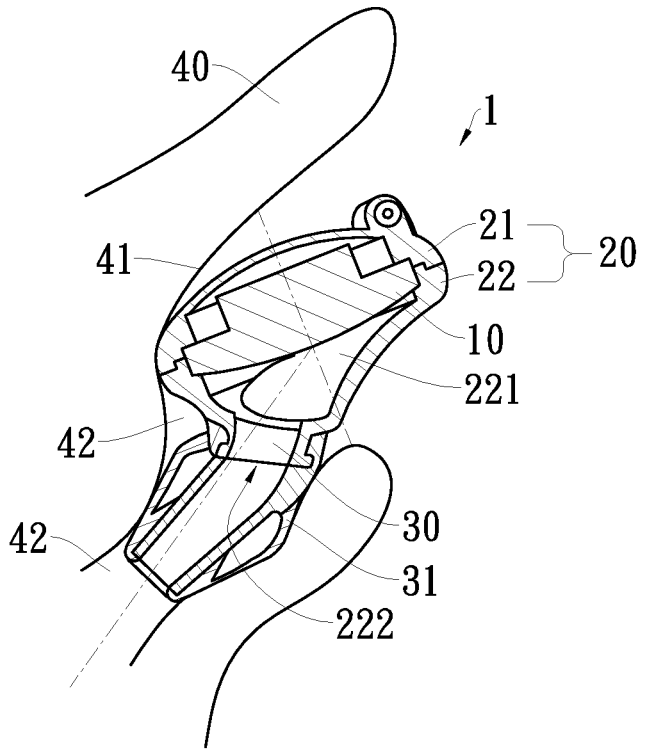
FIG. 4 is a plan view illustrating the sectional view shown FIG. 3B of the earphone being plugged to an ear.

It can be seen in FIGS. 2A and 3B that the guide sound tube 30 is disposed at the opening 222 of the lower shield portion 22; the guide sound tube 30 has an end communicating with the sound chamber 221 and another end extending to the opening 222 such that the acute angle θ with a range of 60°~70° can be formed for offering a good sound quality. Further, a detachable ear cushion 31 is disposed at the opening 222 of the shield 20 with an inclination with respect to the guide sound tube 30 toward the ear canal 42 as shown in FIG. 4 for blocking foreign noise after the ear cushion 31 being plugged to the ear canal 42. The ear cushion 31 is made of silica gel or soft rubber for being used over a long period comfortably.

Figure 5:
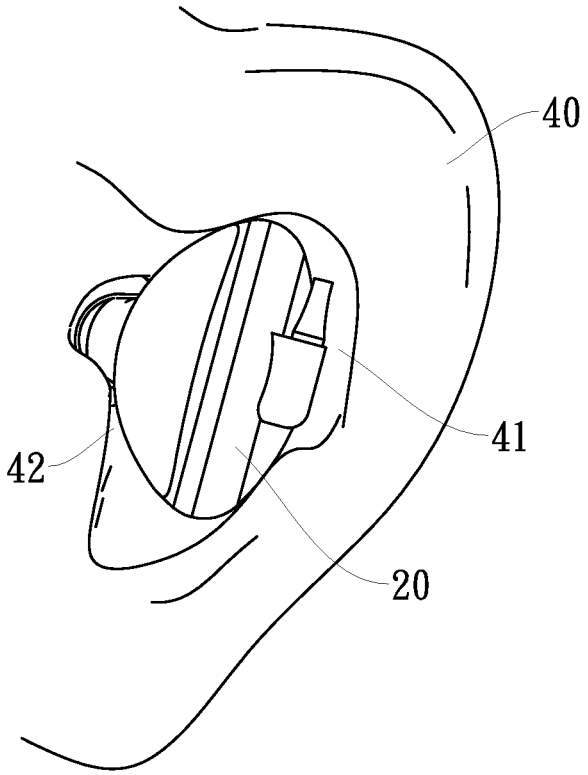
FIG. 5 is a front side view of FIG. 4.

Referring to FIGS. 4 and 5, when the earphone according the present invention is in use and inserted into the ear canal, the ear cushion 31, which is inclining an angle with respect to the guide sound tube 30, plugs to the ear canal 42 to avoid the foreign noise entering the ear 40; the shield 20, which has a configuration of circular shape in associated with an inverted triangle shape, can be inserted into the ear nest 41 of the user for locating the earphone 1 and supporting the weight of the earphone 1. Thus, the user can wear the earphone 1 well comfortably even if the trumpet unit 10 is large size and heavy. In addition, the structure of the shield 20 resists the trumpet unit 10 to hang down or separate from the sound guide tube 30; the trumpet unit 10 is capable of moving 5 mm±1 mm horizontally along the axis of the shield 20 and 8 mm±1 mm vertically perpendicular to the imaginary axis of the shield 20 from the central position Q respectively, and the opening 222 of the shield 20 is disposed with a acute angle θ of 60°~70° for being passed through with the guide sound tube 30 for the high and low pitches of the sound being presented completely.

Figure 6:
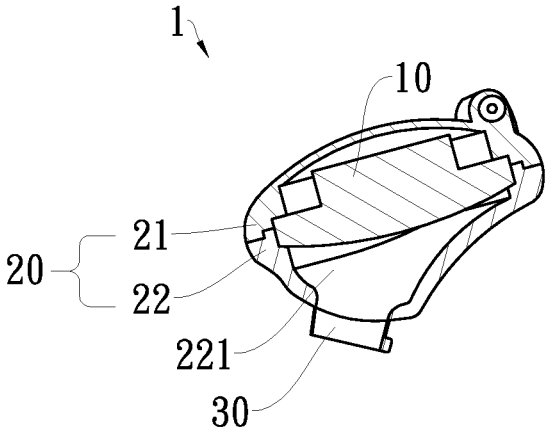
FIG. 6 is a sectional view of the earphone in accordance with the present invention without the ear cushion.

Referring to FIG. 6, the ear cushion 31 can be attached to or unattached from the guide sound tube 30 such that the ear cushion 31 can be made in different sizes for being selected by the users to fit their ear canals 42 individually. Hence, it enhances tightness and functionality while the earphone 1 being worn. For instance, the earphone 1 can be kept clean to maintain personal hygiene of the user because the ear cushion 31 is capable of being unattached before the earphone 1 is lent to others. In this way, it avoids the contagious substance such as the earwax in the ear canal to infect others, and the ear cushion 31 can be replaced when it is damaged or becomes dirty.

Although the invention has been explained in relation to its preferred embodiment, it is to be understood that many other possible modifications and variations can be made without departing from the spirit and scope of the invention as hereinafter claimed.

What is claimed is:

1. An earphone comprising:

a trumpet unit being utilized to transmit sound wave outward;

a hollow shield further comprising an upper shield portion and a lower shield portion, wherein the lower shield portion is joined to the upper shield portion to receive the trumpet unit, and there is a sound chamber disposed in the lower shield portion facing the trumpet unit;

a guide sound tube with an opening extending outward the lower shield portion, inclining an acute angle denoted by θ with respect to the trumpet unit, and communicating with the sound chamber;

an ear cushion being detachably joined to the guide sound tube with an inclination to the guide sound tube;

wherein, the ear cushion is plugged to an ear canal to admit the sound wave into the ear canal and block foreign noise, the shield is inserted in an ear nest next to the ear canal to locate and support the earphone, and the sound wave enters the ear canal straight along the ear cushion via the sound chamber and the guide sound tube.

2. The earphone as defined in claim 1, wherein said upper shield portion has a circular shape, and said lower shield portion has an inverted triangle shape.

3. The earphone as defined in claim 1, wherein said trumpet unit is sandwiched between the upper and lower shield portions and communicates with the sound chamber.

4. The earphone as defined in claim 1, wherein the acute angle is between 60°~70°.

5. The earphone as defined in claim 1, wherein an axis passes between the upper and lower shield portions and passes through a central point of said trumpet unit, and a horizontal distance along the axis and a vertical distance perpendicular to the axis are measured from the central position of the trumpet unit to a center of said opening respectively.

6. The earphone as defined in claim 5, wherein said horizontal distance is 5 mm±1 mm and said vertical distance is 8 mm±1 mm.

7. The earphone as defined in claim 1, wherein the ear cushion is made of silica gel or soft rubber.

* * * * *